US006623623B2

(12) United States Patent
Kalnes

(10) Patent No.: US 6,623,623 B2
(45) Date of Patent: Sep. 23, 2003

(54) SIMULTANEOUS HYDROPROCESSING OF TWO FEEDSTOCKS

(75) Inventor: Tom N. Kalnes, La Grange, IL (US)

(73) Assignee: UOP LLC, Des Plaines, IL (US)

( * ) Notice: Subject to any disclaimer, the term of this patent is extended or adjusted under 35 U.S.C. 154(b) by 169 days.

(21) Appl. No.: 09/894,500

(22) Filed: Jun. 28, 2001

(65) Prior Publication Data

US 2003/0010678 A1 Jan. 16, 2003

(51) Int. Cl.[7] ..... C10G 65/12

(52) U.S. Cl. ..... 208/89; 208/58; 208/59; 208/108

(58) Field of Search ..... 208/89, 58, 59, 208/108

(56) References Cited

U.S. PATENT DOCUMENTS

| | | | | |
|---|---|---|---|---|
| 3,328,290 A | | 6/1967 | Hengstebeck | 208/89 |
| 5,403,469 A | | 4/1995 | Vauk et al. | 208/78 |
| 5,720,872 A | | 2/1998 | Gupta | 208/57 |
| 5,980,729 A | | 11/1999 | Kalnes et al. | 208/89 |
| 6,106,694 A | * | 8/2000 | Kalnes et al. | 208/57 |
| 6,190,535 B1 | * | 2/2001 | Kalnes et al. | 208/89 |
| 6,315,889 B1 | * | 11/2001 | Thakkar et al. | 208/59 |
| 6,328,879 B1 | * | 12/2001 | Kalnes | 208/78 |
| 6,361,683 B1 | * | 3/2002 | Kalnes | 208/89 |
| 6,379,533 B1 | * | 4/2002 | Thakkar et al. | 208/59 |
| 6,402,935 B1 | * | 6/2002 | Kalnes | 208/89 |

* cited by examiner

*Primary Examiner*—Walter D. Griffin
(74) *Attorney, Agent, or Firm*—John G. Tolomei; James C. Paschall; John G. Cutts, Jr.

(57) ABSTRACT

A catalytic hydrocracking process which simultaneously hydroprocesses two feedstocks to provide higher liquid product yields and increase the quality of the liquid products. A first feedstock is passed to a denitrification and desulfurization reaction zone to produce a stream which is in turn passed to a hot, high pressure stripper utilizing a hot, hydrogen-rich stripping gas to produce a first vapor stream and a first liquid stream. At least a portion of the first liquid stream is passed to a hydrocracking zone. A second feedstock having an average boiling point lower than the first feedstock in one embodiment is passed into an upper end of the hot, high pressure stripper to serve as reflux and in another embodiment is passed to an intermediate location in the denitrification and desulfurization reaction zone to serve as quench.

20 Claims, 1 Drawing Sheet

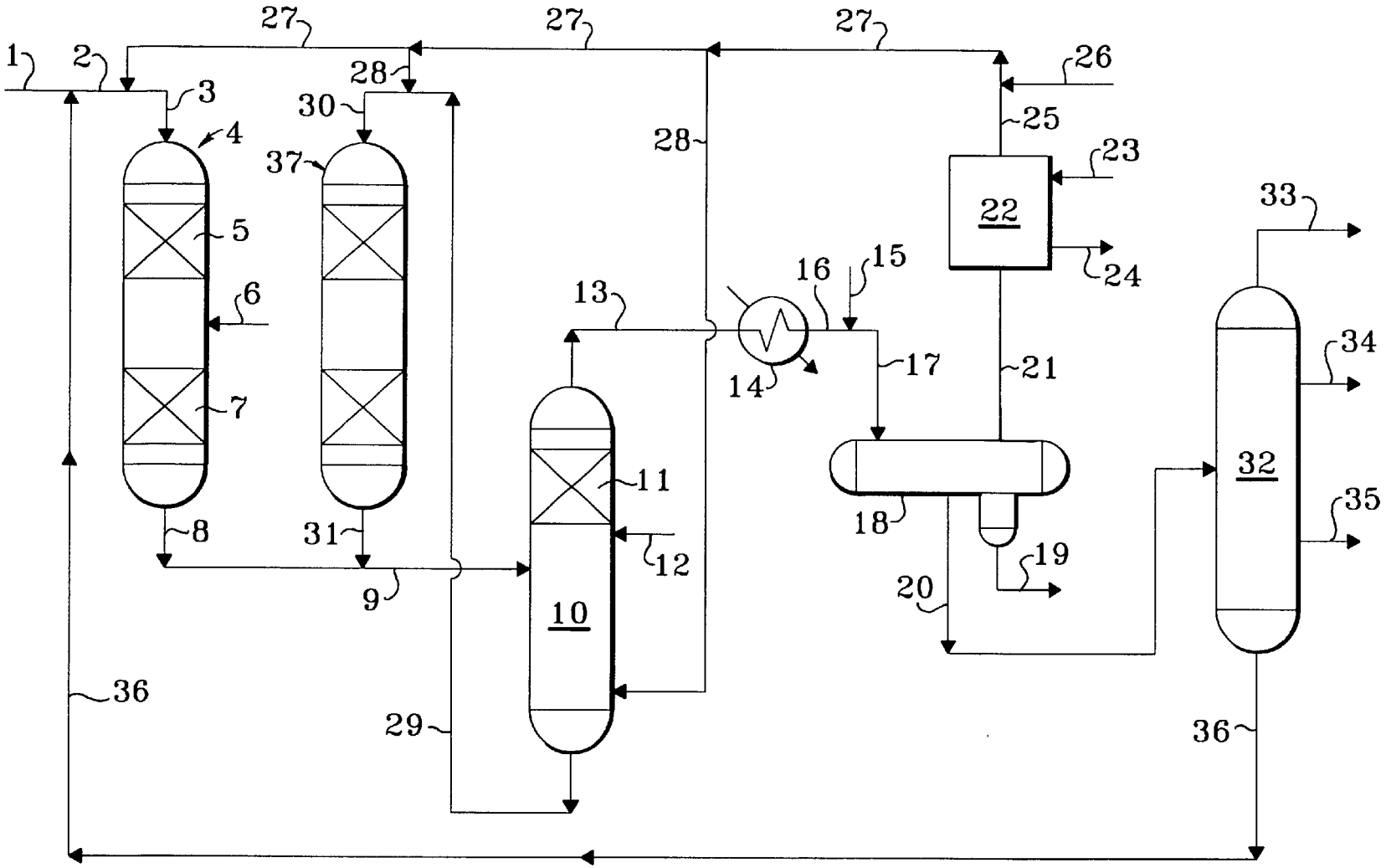
1
2
3
4
5
6
7
8
9
10
11
12
13
14
15
16
17
18
19
20
21
22
23
24
25
26
27
28
29
30
31
32
33
34
35
36
37

SIMULTANEOUS HYDROPROCESSING OF TWO FEEDSTOCKS

BACKGROUND OF THE INVENTION

The field of art to which this invention pertains is the simultaneous hydroprocessing of two hydrocarbonaceous feedstocks. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical heavy gas oil comprises a substantial portion of hydrocarbon components boiling above about 700° F., usually at least about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Although a wide variety of process flow schemes, operating conditions and catalysts have been used in commercial activities, there is always a demand for new hydrocracking methods which provide lower costs and higher liquid product yields and higher quality products. Low conversion per pass is generally more expensive, however, the present invention greatly improves the economic benefits of a low conversion per pass process and demonstrates the unexpected advantages.

INFORMATION DISCLOSURE

U.S. Pat. No. 5,720,872 B1 discloses a process for hydroprocessing liquid feedstocks in two or more hydroprocessing stages, which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

U.S. Pat. No. 3,328,290 B1 (Hengstebeck) discloses a two-stage process for the hydrocracking of hydrocarbons in which the feed is pretreated in the first stage.

U.S. Pat. No. 5,114,562 B1 (Haun et al) discloses a process wherein a middle distillate petroleum stream is hydrotreated to produce a low sulfur and low aromatic product employing two reaction zones in series. The effluent from the first reaction zone (desulfurization) is cooled and introduced into a hydrogen stripping zone wherein hydrogen sulfide is removed overhead along with a small amount of hydrocarbons which were in the vapor at conditions present at the top of the stripping zone. The bottom stream from the stripping zone is reheated and introduced into the second reaction zone (aromatic saturation) containing sulfur-sensitive noble metal hydrogenation catalyst. The operating pressure increases and the temperature decreases from the first to the second reaction zones. The desulfurization conditions employed are relatively moderate as only a very limited amount of cracking is desired. It is totally undesired to perform any significant cracking within the second reaction zone. It is specifically desired to minimize the content of heavy product distillate hydrocarbons such as diesel fuel in the vapor phase of the stripping zone.

U.S. Pat. No. 5,980,729 B1 (Kalnes et al) discloses a hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream.

U.S. Pat. No. 5,403,469 B1 (Vauk et al) discloses a parallel hydrotreating and hydrocracking process. Effluent from the two processes are combined in the same separation vessel and separated into a vapor comprising hydrogen and a hydrocarbon-containing liquid. The hydrogen is shown to be supplied as part of the feed streams to both the hydrocracking and the hydrotreater.

BRIEF SUMMARY OF THE INVENTION

The present invention is a catalytic hydrocracking process which simultaneously hydroprocesses two feedstocks to provide higher liquid product yields and increase the quality of the liquid products. The process of the present invention provides the yield advantages associated with a low conversion per pass operation without compromising unit economics. In addition, lower capital costs will be realized with the use of the present invention.

In the present invention, a first hydrocarbonaceous feedstock and hydrogen are passed to a denitrification and desulfurization reaction zone to produce a stream which is in turn passed to a hot, high pressure stripper utilizing a hot, hydrogen-rich stripping gas to produce a first vapor stream containing hydrogen, hydrogen sulfide, ammonia and hydrocarbonaceous compounds, and a first liquid stream containing hydrocarbonaceous compounds boiling in the range of the first feedstock. At least a portion of the first liquid stream is passed to a hydrocracking zone. A second hydrocarbonaceous feedstock having an average boiling temperature lower than the first hydrocarbonaceous feedstock in one embodiment is passed into an upper end of the hot, high pressure stripper to serve as reflux and in another embodiment is passed into an intermediate location in the denitrification and desulfurization reaction zone to serve as quench. The vapor stream containing hydrogen and hydrocarbonaceous compounds boiling at a temperature below the first feedstock is introduced into a post-treat hydrogenation reaction zone to saturate at least a portion of the aromatic compounds contained therein. In one embodiment, at least a portion of the second feedstock is vaporized in the hot, high pressure stripper and passes into the post-treat hydrogenation reaction zone to saturate aromatic compounds and thereby improve the quality of the hydrocarbonaceous effluent from the post-treat zone. In another embodiment, the second hydrocarbonaceous feedstock serves as quench and passes through at least a portion of the catalyst in the denitrification and desulfurization reaction zone and is subsequently introduced into the hot, high pressure stripper. At least a portion of the effluent from the post-treat hydrogenation reaction zone is condensed to produce a liquid stream containing hydrocarbonaceous compounds boiling at a temperature below the first feedstock and a vapor stream containing hydrogen and hydrogen sulfide. In a preferred embodiment, at least a portion of the hydrogen sulfide is removed from the second vapor stream before it is recycled to the hydrocracking zone.

In accordance with one embodiment the present invention relates to a process for the simultaneous hydroprocessing of two feedstocks having different boiling ranges which process comprises: (a) passing a first hydrocarbonaceous feedstock and hydrogen to a denitrification and desulfurization reaction zone containing a hydrotreating catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a denitrification and desulfurization reaction zone effluent therefrom; (b) passing the denitrification and desulfurization reaction zone effluent directly to a hot, high pressure stripper utilizing a hot, hydrogen-rich stripping gas to produce a first vapor stream comprising hydrogen, hydrogen sulfide, ammonia and hydrocarbonaceous compounds and a first liquid stream comprising hydrocarbonaceous compounds boiling in the range of the first hydrocarbonaceous feedstock; (c) passing at least a portion of the first liquid stream comprising hydrocarbonaceous compounds boiling in the range of the first hydrocarbonaceous feedstock to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom; (d) passing the hydrocracking zone effluent directly to the hot, high pressure stripper to produce a second vapor stream comprising lower boiling hydrocarbonaceous compounds and a second liquid stream; (e) passing at least a portion of the first vapor stream recovered in step (b) and at least a portion of the second vapor stream recovered in step (d) to a post-treat hydrogenation reaction zone; (f) condensing at least a portion of the resulting effluent from the post-treat hydrogenation zone to produce a third liquid stream comprising hydrocarbonaceous compounds boiling at a temperature below the first hydrocarbonaceous feedstock and a third vapor stream comprising hydrogen and hydrogen sulfide; (g) passing a second hydrocarbonaceous feedstock having a lower average boiling point than that of the first hydrocarbonaceous feedstock into an upper end of the hot-high pressure stripper to serve as reflux; (h) passing at least a portion of the third vapor stream to the hydrocracking zone; (i) passing at least a portion of the third vapor stream to the denitrification and desulfurization reaction zone; and (j) passing at least a portion of the third vapor stream to the hot, high pressure stripper.

In accordance with another embodiment the present invention relates to a process for the simultaneous hydroprocessing of two feedstocks having different boiling ranges which process comprises: (a) passing a first hydrocarbonaceous feedstock and hydrogen to a denitrification and desulfurization reaction zone containing a hydrotreating catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a denitrification and desulfurization reaction zone effluent therefrom; (b) passing the denitrification and desulfurization reaction zone effluent directly to a hot, high pressure stripper utilizing a hot, hydrogen-rich stripping gas to produce a first vapor stream comprising hydrogen, hydrogen sulfide, ammonia and hydrocarbonaceous compounds and a first liquid stream comprising hydrocarbonaceous compounds boiling in the range of the first hydrocarbonaceous feedstock; (c) passing at least a portion of the first liquid stream comprising hydrocarbonaceous compounds boiling in the range of the first hydrocarbonaceous feedstock to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom; (d) passing the hydrocracking zone effluent directly to the hot, high pressure stripper to produce a second vapor stream comprising lower boiling hydrocarbonaceous compounds and a second liquid stream; (e) passing at least a portion of the first vapor stream recovered in step (b) and at least a portion of the second vapor stream recovered in step (d) to a post-treat hydrogenation reaction zone; (f) condensing at least a portion of the resulting effluent from the post-treat hydrogenation zone to produce a third liquid stream comprising hydrocarbonaceous compounds boiling at a temperature below the first hydrocarbonaceous feedstock and a third vapor stream comprising hydrogen and hydrogen sulfide; (g) passing a second hydrocarbonaceous feedstock having a lower average boiling point than that of the first hydrocarbonaceous feedstock into an intermediate location in the denitrification and desulfurization reaction zone to serve as quench; (h) passing at least a portion of the third vapor stream to the hydrocracking zone; (i) passing at least a portion of the third vapor stream to the denitrification and desulfurization reaction zone; and (j) passing at least a portion of the third vapor stream to the hot, high pressure stripper.

Other embodiments of the present invention encompass further details such as types and descriptions of feedstocks, hydrocracking catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not intended to be a limitation thereof.

DETAILED DESCRIPTION OF THE INVENTION

The present invention is particularly useful for hydroprocessing two feedstocks to achieve higher liquid product yields and a lower cost of production. The feedstocks contain hydrocarbons and/or other organic materials to produce a product containing hydrocarbons and/or other organic materials of lower average boiling point and improved product characteristics such as improved cetane and smoke point, and reduced contaminants such as sulfur and nitrogen. The hydrocarbon feedstocks that may be subjected to hydroprocessing by the method of the invention include all mineral oils and synthetic oils (e.g., shale oil, tar sand products, etc.) and fractions thereof. The higher boiling hydrocarbon feedstocks include those containing components boiling above 550° F. such as atmospheric gas oils, vacuum gas oils, deasphalted, vacuum, and atmospheric residua, hydrotreated residual oils, coker distillates, straight run distillates, pyrolysis-derived oils, high boiling synthetic oils and cat cracker distillates. One preferred hydrocracking feedstock is a gas oil or other hydrocarbon fraction having at least 50% by weight and most usually at least 75% by weight, of its components boiling at temperatures above the end point of the desired product, which end point, in the case of heavy gasoline, is generally in the range from about 380° F. to about 420° F. One of the most preferred gas oil feedstocks will contain hydrocarbon components which boil above 550° F. with best results being achieved with feeds containing at least 25 percent by volume of the components boiling between 600° F. and 1000° F. Also included are petroleum distillates wherein at least 90 percent of the components boil in the range from about 300° F. to about 800° F.

The first selected feedstock is first introduced into a denitrification and desulfurization reaction zone at denitrification and desulfurization reaction conditions. Preferred denitrification and desulfurization reaction conditions include a temperature from about 400° F. to about 900° F., a pressure from about 500 psig to about 2500 psig, a liquid hourly space velocity of the fresh hydrocarbonaceous feedstock from about 0.1 $hr^{-1}$ to about 10 $hr^{-1}$ with a hydrotreating catalyst or a combination of hydrotreating catalysts.

The term "denitrification and desulfurization" as used herein refers to a process wherein a hydrogen-containing treat gas is used in the presence of suitable catalysts which are primarily active for the removal of heteroatoms, such as sulfur and nitrogen and for some hydrogenation of aromatics. Suitable catalysts for denitrification and desulfurization in the present invention are any known conventional hydrotreating catalysts and include those which are comprised of at least one Group VIII metal, preferably iron, cobalt and nickel, more preferably cobalt and/or nickel and at least one Group VIII metal, preferably molybdenum and tungsten, on a high surface area support material, preferably alumina. It is within the scope of the present invention that more than one type of hydrotreating catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the denitrification and desulfurization reaction zone is transferred without intentional heat-exchange (uncooled) and is introduced into a hot, high pressure stripping zone maintained at essentially the same pressure as the denitrification and desulfurization reaction zone where it is countercurrently stripped with a hydrogen-rich gaseous stream to produce a first gaseous stream containing hydrogen, hydrogen sulfide, ammonia and hydrocarbonaceous compounds, and a first liquid stream comprising hydrocarbonaceous compounds boiling in the range of the first hydrocarbonaceous feedstock. The hot, high pressure stripping zone is preferably maintained at a temperature in the range from about 450° F. to about 875° F.

The effluent from the denitrification and desulfurization reaction zone is not substantially cooled prior to stripping and would only be lower in temperature due to unavoidable heat loss during transport from the reaction zone to the stripping zone. It is preferred that any cooling of the denitrification and desulfurization reaction zone effluent prior to stripping is less than about 100° F. By maintaining the pressure of the stripping zone at essentially the same pressure as the denitrification and desulfurization reaction zone is meant that any difference in pressure is due to the pressure drop required to flow the effluent stream from the reaction zone to the stripping zone. It is preferred that the pressure drop is less than about 100 psig. The hydrogen-rich gaseous stream is preferably supplied to the stripping zone in an amount greater than about 1 weight percent of the first hydrocarbonaceous feedstock. In one embodiment, the hydrogen-rich gaseous stream used as the stripping medium in the stripping zone is first introduced into a reflux heat exchange zone located in an upper end of the stripping zone to produce reflux therefor and then introducing the resulting heated hydrogen-rich gaseous stream into a lower end of the stripping zone to perform the stripping function.

At least a portion of the first liquid hydrocarbonaceous stream containing hydrocarbonaceous compounds boiling at a temperature in the range of the first feedstock recovered from the hot, high pressure stripping zone is introduced directly into a hydrocracking zone along with added hydrogen.

The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 75%. More preferably the per pass conversion is in the range from about 20% to about 60%.

The effluent from the hydrocracking reaction zone is not substantially cooled and is introduced into the hot, high pressure stripper and would only be lower in temperature due to unavoidable heat loss during transport from the reaction zone to the stripper. It is preferred that any cooling of the hydrocracking zone effluent prior to stripping is less than about 100° F. The hydrocracking pressure is maintained at essentially the same pressure as the stripper and that any difference in pressure is due to the pressure drop required to flow the effluent from the hydrocracking zone to the stripper.

The resulting gaseous hydrocarbonaceous stream containing hydrocarbonaceous compounds boiling at a temperature less than about 650° F., hydrogen, hydrogen sulfide and ammonia from the stripping zone is preferably introduced in an all vapor phase into a post-treat hydrogenation reaction zone to hydrogenate at least a portion of the aromatic compounds in order to improve the quality of the middle distillate, particularly the jet fuel. The post-treat hydrogenation reaction zone may be conducted in a downflow, upflow or radial flow mode of operation and may utilize any known hydrogenation catalyst. The effluent from the post-treat hydrogenation reaction zone is preferably cooled to a temperature in the range from about 40° F. to about 140° F. and at least partially condensed to produce a liquid hydrocarbonaceous stream which is divided to produce at least a portion of the hydrogen-rich gaseous stream introduced into the hot, high pressure stripper, the hydrocracking zone and the desulfurization and denitrogenation reaction zone. Fresh make-up hydrogen may be introduced into the process at any suitable and convenient location. Before the hydrogen-rich gaseous stream is divided and introduced into the hydrocracking reaction zone, it is preferred that at least a significant portion, at least about 90 weight percent, for example, of the hydrogen sulfide is removed and recovered by means of known, conventional methods. In a preferred embodiment, the hydrogen-rich gaseous stream introduced into the hydrocracking reaction zone contains less than about 50 wppm hydrogen sulfide.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil is introduced into the process via line 1 and admixed with a hereinafter-described liquid recycle stream transported via line 36. The resulting admixture is transported via line 2 and is admixed with a hydrogen-rich gaseous stream provided via line 27 and the resulting admixture is carried via line 3 and introduced into denitrification and desulfurization zone 4. The admixture passes through denitrification and desulfurization catalyst zone 5 and is admixed with a liquid stream containing light cycle oil introduced via line 6 and the resulting admixture is passed through denitrification and desulfurization catalyst zone 7. The resulting effluent from the denitrification and desulfurization zone 4 is carried via line 8 and is admixed with a hereinafter-described effluent from hydrocracking zone 37 carried via line 31 and the resulting admixture is carried via line 9 and introduced into stripping zone 10. A liquid hydrocarbonaceous stream is removed from the bottom of stripping zone 10 via line 29 and is admixed with a hydrogen-rich gaseous stream provided via line 28 and the resulting admixture is carried via line 30 and introduced into hydrocracking zone 37. A resulting hydrocracking effluent is removed from hydrocracking zone 37 via line 31 as hereinabove described. A liquid stream containing straight run diesel is carried via line 12 and introduced into stripping zone 10 to serve as reflux. A vaporous stream is stripped and carried upwards in stripping zone 10 and is contacted with hydrogenation zone 11 and a resulting effluent is removed from stripping zone 10 via line 13. The resulting vapor stream contained in line 13 is introduced into heat-exchanger 14 and a partially condensed effluent stream is removed from heat-exchanger 14, carried via line 16, contacted with an aqueous stream carried via line 15 and the resulting admixture is subsequently carried via line 17 and introduced into high pressure separator 18. A gaseous stream containing hydrogen and hydrogen sulfide is removed from high pressure separator 18 via line 21 and introduced into acid gas recovery zone 22. A lean solvent is introduced via line 23 into acid gas recovery zone 22 and contacts the hydrogen-rich gaseous stream in order to dissolve an acid gas. A rich solvent containing acid gas is removed from acid gas recovery zone 22 via line 24 and recovered. A hydrogen-rich gaseous stream containing a reduced concentration of acid gas is removed from acid gas recovery zone 22 via line 25 and is admixed with fresh makeup hydrogen which is introduced via line 26. The resulting admixture is transported via line 27 and a portion thereof is carried via line 28 to serve as stripping gas in stripping zone 10. Another portion of the hydrogen-rich gaseous stream carried via line 27 is transported via line 28 and is introduced into hydrocracking zone 37 as hereinabove described. The third and remaining portion of the hydrogen-rich gaseous stream carried via line 27 is introduced into denitrification and desulfurization reaction zone 4 as hereinabove described. A liquid stream is removed from high pressure separator 18 via line 20 and is introduced into fractionation zone 32. A spent aqueous stream is removed from high pressure separator 18 via line 19 and recovered. Light gaseous hydrocarbons and naphtha boiling range compounds are removed from fractionation zone 32 via line 33 and recovered. A liquid stream containing kerosene boiling range compounds is removed from fractionation zone 32 via line 34 and recovered. A liquid hydrocarbon stream containing diesel boiling range compounds is removed from fractionation zone 32 via line 35 and recovered. A heavy liquid hydrocarbon stream containing compounds boiling in the range greater than diesel boiling range compounds is removed from fractionation zone 32 via line 36 and admixed with the fresh hydrocarbonaceous feed as described hereinabove.

Illustrative Embodiment

A vacuum gas oil feedstock in an amount of 100 mass units and having the characteristics presented in Table 1 is introduced along with a liquid recycle stream into a denitrification and desulfurization reaction zone at operating conditions presented in Table 3. An FCC light cycle oil in an amount of 30 mass units and having the characteristics presented in Table 2 is introduced into an intermediate point in the denitrification and desulfurization reaction zone to serve as quench and to contact at least a portion of the catalyst therein. The resulting effluent from the denitrification and desulfurization reaction zone is combined with the effluent from a hydrocracking zone and introduced into the hot, high pressure stripper operated at a pressure of about 1750 psig and a temperature of about 700° F. The hot, high pressure stripper is refluxed by the introduction of 20 mass units of a straight run diesel having the characteristics presented in Table 2.

TABLE I

| Hydrocracker Feedstock Analysis Vacuum Gas Oil | |
|---|---|
| Gravity, °API | 23 |
| Distillation, Volume Percent | |
| IBP° F. | 432 |
| 5 | 674 |
| 10 | 746 |
| 30 | 806 |
| 50 | 839 |
| 70 | 878 |
| 90 | 937 |
| 95 | 963 |
| Sulfur, weight percent | 2.22 |
| Nitrogen, weight percent | 0.074 |
| (wt. PPM) | (740) |
| Conradson Carbon, weight percent | 0.15 |

TABLE 2

| Co-Feed Analyses | Straight Run Diesel | Light Cycle Oil |
|---|---|---|
| Gravity °API | 28.1 | 19.5 |
| Boiling Range, ° F. | 400–640 | 400–640 |
| Sulfur, weight PPM | 15,000 | 10,000 |
| Cetane Index | 38 | 28 |

A liquid hydrocarbonaceous stream containing hydrocarbons boiling in the range of the vacuum gas oil feedstock is removed from the bottom of the hot, high pressure stripper and is introduced into the hydrocracking zone at operating conditions presented in Table 3.

TABLE 3

| Summary of Operating Conditions | |
|---|---|
| Denitrification and Desulfurization Reaction Zone | |
| Pressure, psig | 1800 |
| Temperature, ° F. | 740 |
| Hydrocracking Reaction Zone | |
| Pressure, psig | 1800 |
| Temperature, ° F. | 725 |
| Conversion Per Pass, % | 35 |

The total conversion to hydrocarbons having a boiling point less than 650° F. is 99.5% and a summary of the overall mass balance is presented in Table 4. An analysis of the distillate product indicates that the sulfur concentration is less than 10 wppm. These results demonstrate the advantages provided by the process of the present invention.

TABLE 4

| Overall Mass Balance | Mass Units |
|---|---|
| Feeds | |
| Vacuum Gas Oil | 100.0 |
| Straight Run Diesel | 20.0 |

TABLE 4-continued

| Overall Mass Balance | Mass Units |
|---|---|
| Light Cycle Oil | 30.0 |
| Hydrogen | 3.2 |
| | 153.2 |
| Products | |
| Hydrogen Sulfide | 3.0 |
| Ammonia | 0.2 |
| $C_1$—$C_4$ | 5.0 |
| Naphtha | 24.0 |
| Distillate | 120.5 |
| Unconverted Oil | 0.5 |
| | 153.2 |

The foregoing description, drawing and illustrative embodiment clearly illustrate the advantages encompassed by the process of the present invention and the benefits to be afforded with the use thereof.

What is claimed:

1. A process for the simultaneous hydroprocessing of two feedstocks having different boiling ranges which process comprises:

(a) passing a first hydrocarbonaceous feedstock and hydrogen to a denitrification and desulfurization reaction zone containing a hydrotreating catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a denitrification and desulfurization reaction zone effluent therefrom;

(b) passing the denitrification and desulfurization reaction zone effluent directly to a hot, high pressure stripper utilizing a hot, hydrogen-rich stripping gas to produce a first vapor stream comprising hydrogen, hydrogen sulfide, ammonia and hydrocarbonaceous compounds and a first liquid stream comprising hydrocarbonaceous compounds boiling in the range of the first hydrocarbonaceous feedstock;

(c) passing at least a portion of the first liquid stream comprising hydrocarbonaceous compounds boiling in the range of the first hydrocarbonaceous feedstock to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom;

(d) passing the hydrocracking zone effluent directly to the hot, high pressure stripper to produce a second vapor stream comprising lower boiling hydrocarbonaceous compounds and a second liquid stream;

(e) passing at least a portion of the first vapor stream recovered in step (b) and at least a portion of the second vapor stream recovered in step (d) to a post-treat hydrogenation reaction zone;

(f) condensing at least a portion of the resulting effluent from the post-treat hydrogenation zone to produce a third liquid stream comprising hydrocarbonaceous compounds boiling at a temperature below the first hydrocarbonaceous feedstock and a third vapor stream comprising hydrogen and hydrogen sulfide;

(g) passing a second hydrocarbonaceous feedstock having a lower average boiling point than that of the first hydrocarbonaceous feedstock into an upper end of the hot-high pressure stripper to serve as reflux;

(h) passing at least a portion of the third vapor stream to the hydrocracking zone;

(i) passing at least a portion of the third vapor stream to the denitrification and desulfurization reaction zone; and (j) passing at least a portion of the third vapor stream to the hot, high pressure stripper.

2. The process of claim 1 wherein the third vapor stream comprising hydrogen and hydrogen sulfide is treated to remove at least a portion of the hydrogen sulfide.

3. The process of claim 2 wherein a resulting hydrogen-rich vapor stream contains less than about 50 wppm hydrogen sulfide.

4. The process of claim 1 wherein the first hydrocarbonaceous feedstock boils in the range from about 650° F. to about 1050° F.

5. The process of claim 1 wherein the hot, high pressure stripper is operated at a temperature and pressure which is essentially equal to that of a combined effluent from the hydrocracking zone and the denitrification and desulfurization reaction zone.

6. The process of claim 1 wherein the hot, high pressure stripper is operated at a temperature no less than about 100° F. below a combined outlet temperature of the hydrocracking zone and denitrification and desulfurization reaction zone, and at a pressure no less than about 100 psig below a combined outlet pressure of the hydrocracking zone and denitrification and desulfurization reaction zone.

7. The process of claim 1 wherein the hydrocracking zone is operated at a conversion per pass in the range from about 15% to about 75%.

8. The process of claim 1 wherein the hydrocracking zone is operated at a conversion per pass in the range from about 20% to about 60%.

9. The process of claim 1 wherein the denitrification and desulfurization reaction zone contains catalyst comprising nickel and molybdenum.

10. The process of claim 1 wherein the post-treat hydrogenation reaction zone is operated at reaction zone conditions including a temperature from about 400° F. to about 900° F. and a pressure from about 500 psig to about 2500 psig.

11. A process for the simultaneous hydroprocessing of two feedstocks having different boiling ranges which process comprises:

(a) passing a first hydrocarbonaceous feedstock and hydrogen to a denitrification and desulfurization reaction zone containing a hydrotreating catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a denitrification and desulfurization reaction zone effluent therefrom;

(b) passing the denitrification and desulfurization reaction zone effluent directly to a hot, high pressure stripper utilizing a hot, hydrogen-rich stripping gas to produce a first vapor stream comprising hydrogen, hydrogen sulfide, ammonia and hydrocarbonaceous compounds and a first liquid stream comprising hydrocarbonaceous compounds boiling in the range of the first hydrocarbonaceous feedstock;

(c) passing at least a portion of the first liquid stream comprising hydrocarbonaceous compounds boiling in the range of the first hydrocarbonaceous feedstock to a hydrocracking zone containing a hydrocracking catalyst and operating at a temperature of about 400° F. to about 900° F., a pressure from about 500 psig to about 2500 psig, a liquid hourly space velocity from about 0.1 $hr^{-1}$ to about 15 $hr^{-1}$ and recovering a hydrocracking zone effluent therefrom;

(d) passing the hydrocracking zone effluent directly to the hot, high pressure stripper to produce a second vapor stream comprising lower boiling hydrocarbonaceous compounds and a second liquid stream;

(e) passing at least a portion of the first vapor stream recovered in step (b) and at least a portion of the second vapor stream recovered in step (d) to a post-treat hydrogenation reaction zone;

(f) condensing at least a portion of the resulting effluent from the post-treat hydrogenation zone to produce a third liquid stream comprising hydrocarbonaceous compounds boiling at a temperature below the first hydrocarbonaceous feedstock and a third vapor stream comprising hydrogen and hydrogen sulfide;

(g) passing a second hydrocarbonaceous feedstock having a lower average boiling point than that of the first hydrocarbonaceous feedstock into an intermediate location in the denitrification and desulfurization reaction zone to serve as quench;

(h) passing at least a portion of the third vapor stream to the hydrocracking zone;

(i) passing at least a portion of the third vapor stream to the denitrification and desulfurization reaction zone; and (j) passing at least a portion of the third vapor stream to the hot, high pressure stripper.

12. The process of claim 11 wherein the third vapor stream comprising hydrogen and hydrogen sulfide is treated to remove at least a portion of the hydrogen sulfide.

13. The process of claim 12 wherein a resulting hydrogen-rich vapor stream contains less than about 50 wppm hydrogen sulfide.

14. The process of claim 11 wherein the first hydrocarbonaceous feedstock boils in the range from about 650° F. to about 1050° F.

15. The process of claim 11 wherein the hot, high pressure stripper is operated at a temperature and pressure which is essentially equal to that of a combined effluent from the hydrocracking zone and the denitrification and desulfurization reaction zone.

16. The process of claim 11 wherein the hot, high pressure stripper is operated at a temperature no less than about 100° F. below a combined outlet temperature of the hydrocracking zone and denitrification and desulfurization reaction zone, and at a pressure no less than about 100 psig below a combined outlet pressure of the hydrocracking zone and denitrification and desulfurization reaction zone.

17. The process of claim 11 wherein the hydrocracking zone is operated at a conversion per pass in the range from about 15% to about 75%.

18. The process of claim 11 wherein the hydrocracking zone is operated at a conversion per pass in the range from about 20% to about 60%.

19. The process of claim 11 wherein the denitrification and desulfurization reaction zone contains catalyst comprising nickel and molybdenum.

20. The process of claim 11 wherein the post-treat hydrogenation reaction zone is operated at reaction zone conditions including a temperature from about 400° F. to about 900° F. and a pressure from about 500 psig to about 2500 psig.

* * * * *